US005601022A

United States Patent [19]

Dauer et al.

[11] Patent Number: 5,601,022

[45] Date of Patent: Feb. 11, 1997

[54] PROCESS AND DEVICE FOR PRODUCING A PRINTING FORM WITH A NARROW TRANSFER FOIL

[75] Inventors: Horst Dauer, Rohrbach; Bernhard Feller, Friedberg; Arnim Franz-Burgholz, Augsburg; Josef Göttling, Friedberg, all of Germany

[73] Assignee: MAN Roland Druckmaschinen AG, Offenbach am Main, Germany

[21] Appl. No.: 374,139

[22] Filed: Jan. 18, 1995

[30] Foreign Application Priority Data

Aug. 27, 1994 [DE] Germany ..... 44 30 555.9

[51] Int. Cl.[6] ..... B41C 1/055; B41C 1/10; B41C 1/06

[52] U.S. Cl. ..... 101/467; 101/401.1; 347/217; 347/264; 400/224.1; 400/227

[58] Field of Search ..... 101/463.1, 465, 101/466, 467, 401.1; 400/227, 224, 224.1, 208.1, 242; 347/215, 216, 217, 262, 264

[56] References Cited

U.S. PATENT DOCUMENTS

| | | | |
|---|---|---|---|
| 3,342,622 | 9/1967 | Croker | 101/463.1 |
| 3,945,318 | 3/1976 | Landsman | 101/467 |
| 4,297,043 | 10/1981 | Dargatz | 400/232 |
| 4,846,065 | 7/1989 | Mayrhofer et al. | 101/467 |
| 5,039,241 | 8/1991 | Yamaji | 400/216.2 |
| 5,072,671 | 12/1991 | Schneider et al. | 101/467 |
| 5,129,321 | 7/1992 | Fadner | 101/467 |
| 5,238,778 | 8/1993 | Hirai et al. | 101/467 |

FOREIGN PATENT DOCUMENTS

| | | | |
|---|---|---|---|
| 0264604 | 4/1988 | European Pat. Off. . | |
| 2927375 | 7/1980 | Germany . | |
| 3248178 | 7/1984 | Germany . | |
| 3809915 | 10/1989 | Germany . | |
| 280038 | 12/1987 | Japan | 101/467 |

*Primary Examiner*—Stephen R. Funk

*Attorney, Agent, or Firm*—Cohen, Pontani, Lieberman, Pavane

[57] ABSTRACT

In order to permit a printing form to be produced by laser-induced thermotransfer in a simple manner that can be integrated into the printing machine, without the gases which arise during laser imaging detectably disturbing the transfer of material from the transfer foil, i.e., the image quality, a strip-type transfer foil with a strip width that is small relative to the printing form width is used. During imaging, this transfer foil is conveyed continually between the printing form and the laser beam, close to the printing form surface, and is thereby moved simultaneously and synchronously with the movement of the laser beam across the printing form width.

19 Claims, 2 Drawing Sheets

PROCESS AND DEVICE FOR PRODUCING A PRINTING FORM WITH A NARROW TRANSFER FOIL

BACKGROUND OF THE INVENTION

The invention relates to a process and a device for producing a printing form by controlled heating of a surface layer in accordance with an image by means of one or more laser beams and the application of the controlled surface elements to a printing form, especially to a seamless printing form cylinder.

DESCRIPTION OF THE PRIOR ART

This manner of coating a printing form on which an image to be printed can be represented by respective hydrophobic and hydrophilic areas, particularly by means of a laser, is known from DE 32 48 178 C2. A layer which absorbs printing ink is applied to a seamless printing cylinder, which has an anodized or brushed aluminum surface, by thermally heating a transfer foil with a semiconductor laser. To allow a printing form of this type to be coated repeatedly in accordance with an image, modules are arranged in the printing machine, consisting of a device to supply the thermotransfer foil to the cylinder, a laser print head which can be coordinated with the rotational movement of the printing form cylinder, an electronically controlled picture element transfer unit for activating the laser print head, and a component which can remove the image-wise coating from the printing form.

U.S. Pat. No. 3,945,318 addresses, on the one hand, the fact that the satisfactory transfer of material from a thermotransfer foil onto a printing form is possible only when the foil and the printing form remain in constant and even contact with one another or at least are located very close together. On the other hand, the document discusses a problem which occurs, in particular, in laser-induced thermotransfer processes namely, the short-term local heating of a thermotransfer material which is suitably coated with a thermoplastic, thermoreactive or thermoadhesive substance, i.e., its absorption of laser energy, not only melts the material, but also forms gaseous combustion products, which are then found between the thermotransfer foil and the printing form surface to be imaged.

During imaging, this effect can seriously impair the image-wise transfer of surface elements from the foil if a gas layer builds up between the thermotransfer foil and the printing form surface, causing irregularities in the even contact between the foil and the printing form or in their snug fit.

The subject matter of U.S. Pat. No. 3,945,318 therefore proposes the use of electrostatic attraction, i.e., electrostatic charging, for example, of the thermotransfer foil, in order to maintain constant contact between the printing form and the thermotransfer foil, whereby the printing from is executed with a granulated or roughened lithographic surface, so that the gas can escape through channels between the printing form surface and the foil.

Furthermore, DE 29 27 375 C2 describes a process in which underpressure is used to maintain good contact between the printing form surface and the thermotransfer foil.

This underpressure passes through the thermotransfer material, and the substrate material of the foil has a large number of channels for extracting air between the foil and the printing form surface.

These known possible solutions of the problem of disruptive gas formation during laser-induced thermotransfer processes are either only suitable for use in the imaging of rough printing form surfaces (e.g., aluminum printing plates) outside of the printing machine, or else require an expensive production process for the thermotransfer foil and/or the surface to be printed.

SUMMARY OF THE INVENTION

The object of the invention is therefore to further develop a generic process, as well as a device for carrying out this process, which permits a printing form to be produced, especially on a seamless printing form cylinder with a smooth surface, in a simple manner that can be integrated into the printing machine, without the gases created during laser imaging detectably disrupting the transfer of material from the thermotransfer foil, i.e., the image quality.

According to the invention, this object is attained in a surprisingly simple manner through a process in which a strip-type transfer foil having a strip width that is small relative to the printing form width is conveyed continually between the printing form cylinder and the at least one laser beam for heating. Additionally, the foil is moved simultaneously and synchronously with the movement of the laser beam across the printing form width.

The inventive object is further obtained by a device for producing a printing form, which device includes a print head that emits at least one laser beam and is arranged to be traversable across a width of the printing form. Control means are provided for controlling the print head in keeping with an image to be transferred. Strip transport means are provided for continuously conveying a strip-type transfer foil between the printing form and the print head. The strip-type transfer foil has a part that yields surfaced elements and a strip width which is small relative to the printing form width. Additionally, traversing means are operatively associated with the strip transport means and are linked to the print head for moving at least the part of the transfer foil which yields the surface elements in conformity with movement of the print head across the printing form width.

By using a strip-type transfer foil with a strip width that is small relative to the printing form width and by passing this transfer foil continuously between the printing form surface and the laser beam and, at the same time, moving it synchronously with the movement of the laser beam across the printing form width, it is possible to maintain good contact or a defined distance between the thermotransfer material and the printing form surface, because the gas produced during laser imaging can escape in sufficient measure, due to the smallness of the area in which the printing form and the transfer foil face one another.

Another very particular advantage of using a comparatively narrow strip-type transfer foil is that the transfer foil can be much thinner than has been permitted by the current prior art.

Because the strip-type transfer foil with a strip width equalling only a fraction of the printing form width can be conveyed by means of the strip transport mechanism between the printing form and the print head in the immediate vicinity of the printing form surface, and because the strip transport mechanism works together with a traversing unit linked to the print head, the transfer foil can be moved across the printing form width in the same manner as the print head is moved. Thus, the laser-induced thermal print head, which is controlled by a control unit in the known manner in keeping with an image to be transferred, can introduce heat onto the thermotransfer foil at each picture element, and can therefore carry out the point-wise transfer of the ink-absorbing coating of the transfer strip, and in this way can image the complete printing form in an all-around fashion, particularly the complete seamless printing form cylinder.

In another embodiment, the strip width of the transfer foil can be selected in accordance with the number of imaging channels of the laser print head traversing along the axis of a rotating cylinder, i.e., executed in a print-head-ready fashion.

In an especially preferred thermotransfer process, the transfer foil can be conveyed during imaging at a speed acting in the same direction as the relative movement of the printing form cylinder, but increased, preferably by a factor of 1.2, relative to the surface speed of the printing form. This makes it possible to better prevent the undefined lifting of the transfer foil from the surface of the printing form cylinder during laser imaging, due to the air flow between the transfer foil and the printing form surface.

In a further advantageous embodiment of the process with the same advantageous effects, the transfer foil is conveyed during imaging between the printing form surface and the print head in the direction opposite to the rotational movement of the printing form cylinder, permitting a very fast relative movement of the transfer foil to be achieved.

However, the speed at which the transfer foil is conveyed through can also be in the same direction as and less than the surface speed or equal to the surface speed of the printing form cylinder.

In another embodiment, the transfer foil is positioned relative to the printing form surface so that the strip path of the foil runs tangentially to the printing form surface and so that the transfer foil is across from the printing form surface only in an area which is being imaged at a particular moment. It is also possible to position the transfer foil relative to the printing form surface so that the strip-path runs at a slant to a tangent of the printing form surface.

In yet another embodiment of the inventive device, the strip transport mechanism or means includes a supply roller, a wind-up roller and two positioning rollers operatively arranged axis-parallel to the printing form width to position the transfer foil onto the printing form surface. The strip transfer mechanism and the print head are mounted on a common traversing unit.

In still another embodiment the two positioning rollers are arranged parallel to the printing cylinder and at least two turning rollers are provided. The positioning rollers and the turning rollers are arranged to be moveable across the printing form width together with the print head by the traversing means, independent of the supply roller and the wind-up roller.

Yet another embodiment of the inventive device provides electronically controllable motors for driving the supply roller and the wind-up rollers so that during conveyance of the transfer foil the strip tension is kept constant.

Which of the described variants will provide the best imaging results depends on the thickness of the transfer foil as well as on the adjusted strip tension.

Examples of the invention are explained below in greater detail in reference to the drawings.

DETAILED DESCRIPTION OF THE PREFERRED EMBODIMENTS

The control structure and functioning of print heads which emit one or more laser beams is known per se and therefore needs no further explanation in the present context.

Figure 1:
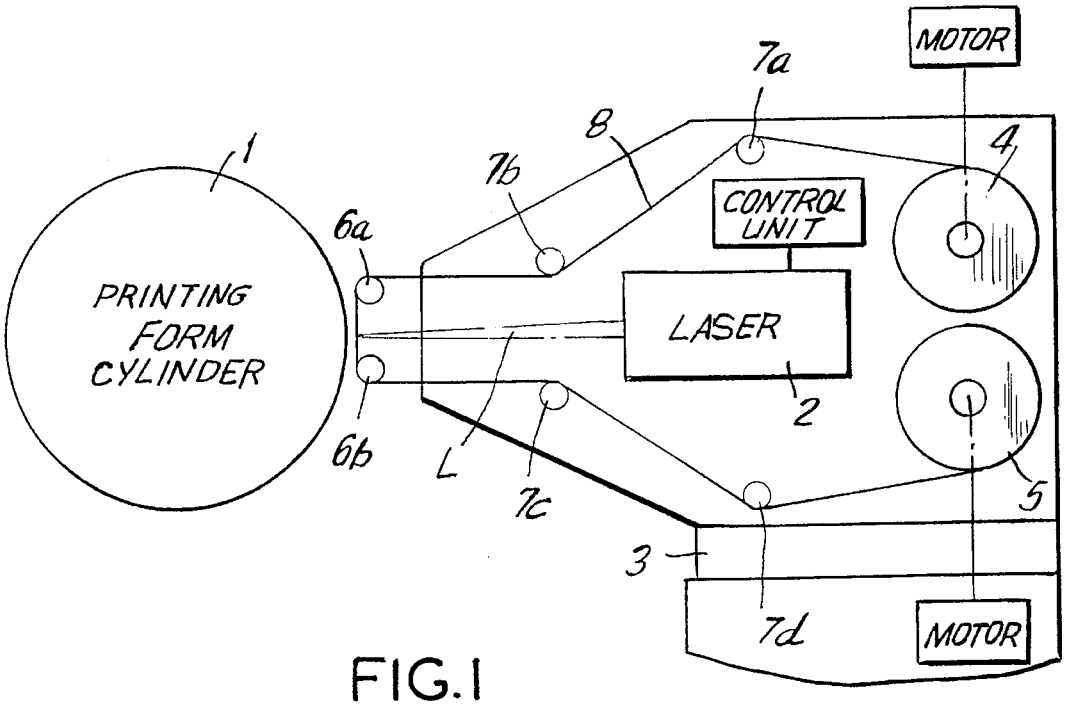
FIG. 1 is a side view of a thermotransfer device for carrying out the process according to the invention, with a first strip transport mechanism.

FIG. 1 shows a seamless printing form cylinder 1, on the surface of which a laser print head 2 which emits one or more laser beams L is targeted. The laser print head 2 is arranged on a traversing unit 3, by means of which it can be moved across the width B of the printing cylinder 1. A strip transport mechanism, consisting of a supply roller 4 and a wind-up roller 5 (this labelling of the supply roller 4 and the wind-up roller 5 simply represents one direction in which the thermotransfer foil 8 may be conducted; in the reverse direction, the designations would naturally be the supply roller 5 and the wind-up roller 4), two positioning rollers 6*a*, 6*b* and four guide rollers 7*a*, 7*b*, 7*c*, 7*d*, conveys the thermotransfer foil 8 between the printing form cylinder 1 and the printing head 2 directly on or with a line-type contact with the printing form surface.

The laser print head 2 and the strip transport mechanism 4, 5, 6, 7 are jointly arranged on the traversing unit 3.

Figure 2:
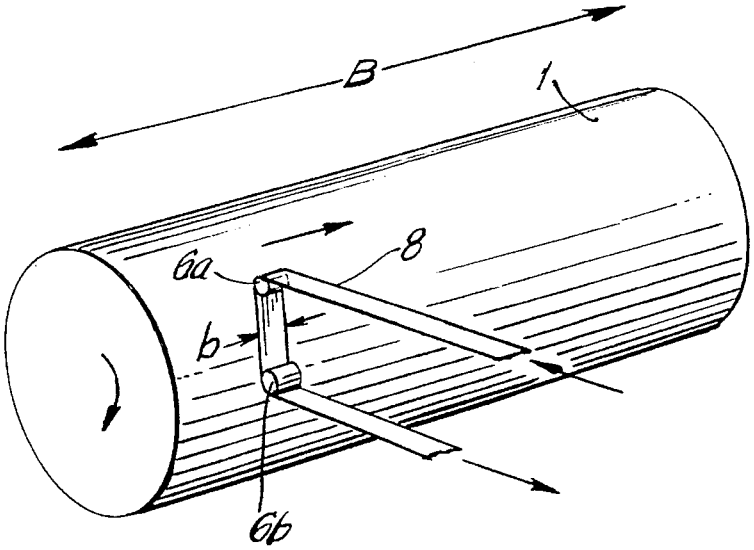
FIG. 2 shows a possible positioning of the transfer foil relative to the printing form surface in perspective.

FIG. 2 shows, in perspective, the strip-type transfer foil 8 with a strip width b that is small relative to the printing form width B. During imaging, the transfer foil 8 is positioned by means of the positioning rollers 6*a*, 6*b* onto the surface of the printing form cylinder 1 only in that small area which is directly impinged upon by the laser, so that at the most a line-type contact of the transfer foil 8 with the printing form cylinder 1 can take place.

In FIG. 2, the arrangement of the positioning rollers 6*a*, 6*b*, and thus the positioning of the transfer foil 8, is selected in such a way that the strip-path of the controlled area of the transfer foil 8 runs tangentially to the printing form cylinder.

Figure 3:
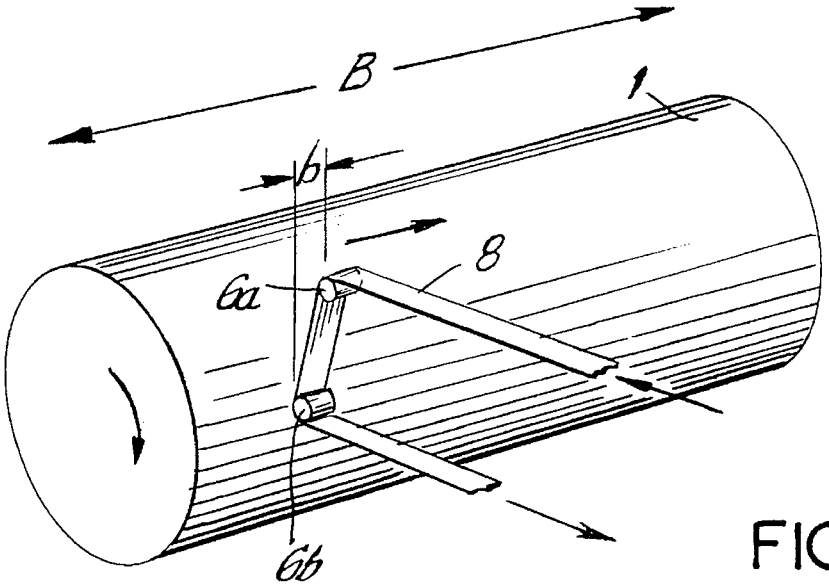
FIG. 3 shows another possible positioning of the transfer foil relative to the printing form surface in perspective.

Another possibility is shown in FIG. 3. Here the positioning rollers 6*a*, 6*b* are arranged in such a way that the strip-path of the positioned area of the transfer foil 8 runs at a slant to the tangent of the printing form cylinder 1. In this way, a defined pressing of the transfer foil 8 onto the printing form surface is possible by means of one of the positioning rollers 6*b*.

In the manner known, the supply roller 4 and the wind-up roller 5 are driven by means of electronically controllable motors, so that during the conveying of the transfer foil 8 the strip tension can be kept constant. The transport direction and the traversing movement are illustrated in FIGS. 2 and 3 by arrows. Of course, the transport of the transfer foil 8 can also occur in the opposite direction.

Figure 4:
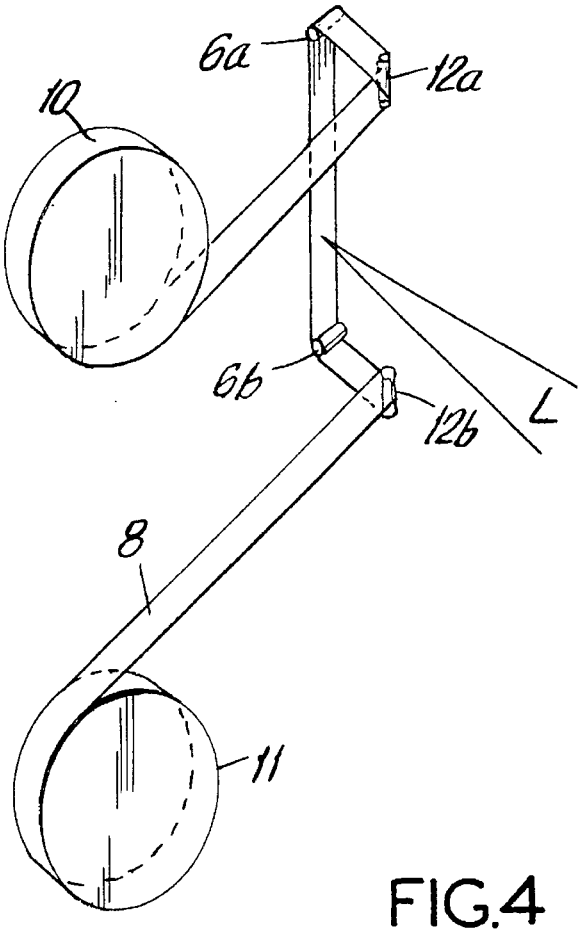
FIG. 4 shows a second strip transport mechanism in perspective.

Another example of a device for carrying out the process for laser-induced thermotransfer is shown in FIG. 4. Here the strip transport mechanism includes a stationary supply roller 10 and wind-up roller 11 (naturally, the designations 10 and 11 for the supply and wind-up rollers are again interchangeable), the two rollers 6*a*, 6*b* arranged axis-parallel to the printing form cylinder 1 for positioning the transfer foil 8 on the printing form surface, as well as two additional turning rollers 12*a*, 12*b*. The positioning rollers 6*a*, 6*b* and the turning rollers 12*a*, 12*b* are in fixed arrangement relative to one another, but, independently of the stationary supply roller 10 and wind-up roller 11, are traversable together with the laser print head 2 by means of a traversing unit along the width B of the printing form cylinder 1.

In the examples, the transfer foil preferably has a strip width of 12 mm and a thickness of approximately 6 u. In comparison to this, the typical width B of a printing form cylinder is 50 cm.

It is indeed possible for the concept according to the invention to be integrated into a printing machine. However, the invention is by no means limited to coating a printing form in accordance with an image within a printing machine; rather, it is also suitable in principle for producing a printing form outside of a printing machine. The print image carrier can thereby be a seamless printing form cylinder, a cylinder sleeve, or a conventional non-coated printing plate which is clamped onto a printing cylinder.

We claim:

1. A process for producing a printing form on a printing form cylinder by controlled heating in accordance with an image with at least one laser beam of a laser print head, comprising:

applying controlled elements of the image to a rotating printing form cylinder having a printing form surface and a printing form width;

moving the at least one laser beam in a direction across the printing form width;

conveying a strip-type transfer foil, having a strip width that is substantially smaller than the printing form width so that the printing form and the transfer foil oppose one another over a small surface area, continually between the printing form cylinder and the at least one laser beam close to the printing form surface during imaging in a direction orthogonal to the moving direction of the laser beam so that a sufficient quantity of material is transferred from the transfer foil to the printing form by the at least one laser beam and so that gas produced during imaging can escape due to the small opposing surface area; and moving the foil simultaneously and synchronously with the movement of the at least one laser beam across the printing form width.

2. A process as defined in claim 1, wherein the print head has a number of imaging channels, the process further including traversing the printing head along an axis parallel to the axis of the rotating printing form cylinder and selecting the strip width of the transfer foil to substantially correspond to the width of the imaging channels of the laser print head.

3. A process as defined in claim 2, further including positioning the transfer foil relative to the printing form surface so that a strip-path of the foil runs tangentially to the printing form surface and so that the transfer foil is across from the printing form surface only in an area which is being :imaged at a particular moment.

4. A process as defined in claim 2, further including positioning the transfer foil relative to the printing form surface so that a strip-path of the foil runs at a slant to a tangent on the printing form surface.

5. A process as defined in claim 2, wherein the transfer foil conveying step includes conveying the transfer foil during imaging at a speed acting in a common direction with relative movement of the printing form cylinder, which speed is higher than a surface speed of the printing form.

6. A process as defined in claim 5, wherein the transfer foil conveying step includes conveying the transfer foil 1.2 times faster than a rotational speed of the printing form cylinder.

7. A process as defined in claim 2, wherein the transfer foil conveying step includes conveying the transfer foil during imaging at a speed acting in a common direction with relative movement of the printing form cylinder, which speed is lower than a surface speed of the printing form.

8. A process as defined in claim 2, wherein the transfer foil conveying step includes conveying the transfer foil during imaging in a direction opposite to a rotational direction of the printing form cylinder.

9. A process as defined in claim 2, wherein the transfer foil conveying step includes conveying the transfer foil during imaging at a speed of equal direction and equal magnitude to rotational movement of the printing form cylinder.

10. A process as defined in claim 1, further including maintaining the transfer foil at a constant strip tension during imaging.

11. A device for producing a printing form having a printing form surface, comprising:

a print head that emits at least one laser beam and is arranged to be traversable over a distance across a width of the printing form;

control means for controlling the print head in keeping with an image to be transferred;

a strip-type transfer foil having a portion that yields image elements and a strip width that is substantially smaller than the printing form width;

strip transport means for continuously conveying the strip-type transfer foil between the printing form and the print head close to the printing form surface during imaging in a direction orthogonal to the width of the printing form so that there is a small opposing surface area between the printing form and the transfer foil sufficient to permit the at least one laser beam to soften and transfer material from the transfer foil to the printing form and to permit gas produced during imaging to escape from between the printing form and the transfer foil; and traversing means operatively associated with the strip transport means and linked to the print head for moving at least the portion of the transfer foil yielding the image elements in conformity with movement of the print head across the printing form width.

12. A device as defined in claim 11, wherein the strip transport means includes a supply roller, a wind-up roller and two positioning rollers operatively arranged axis-parallel to the printing form width to position the transfer foil onto the printing form surface, the strip transport means and the print head being mounted to the traversing means.

13. A device as defined in claim 12, and further comprising electronically controllable motor means for driving the supply roller and the wind-up roller so that during conveying of the transfer foil the foil is maintained at a constant strip tension.

14. A device as defined in claim 12, wherein the positioning rollers are arranged so that the foil has a strip-path oriented tangentially to the printing form surface.

15. A device as defined in claim 12, wherein the positioning rollers are arranged so that the foil has a strip-path oriented at a slant to a tangent on the printing form surface.

16. A device as defined in claim 11, wherein the strip transport means includes a stationary supply roller, stationary a wind-up roller, at least two positioning rollers arranged parallel to the printing form to position the transfer foil relative to the printing form surface, and at least two turning rollers, the positioning rollers and the turning rollers being arranged to be moveable across the printing form width together with the print head by the traversing means, independent of the supply roller and the wind-up roller.

17. A device as defined in claim 16, and further comprising electronically controllable motor means for driving the supply roller and the wind-up roller so that during conveying of the transfer foil the foil is maintained at a constant strip tension.

18. A device as defined in claim 16, wherein the positioning rollers are arranged so that the foil has a strip-path oriented tangentially to the printing form surface.

19. A device as defined in claim 16, wherein the positioning rollers are arranged so that the foil has a strip-path oriented at a slant to a tangent on the printing form surface.

* * * * *